US008579048B2

(12) United States Patent
Weixler et al.

(10) Patent No.: US 8,579,048 B2
(45) Date of Patent: Nov. 12, 2013

(54) DRILLING DEVICE AND DRILLING METHOD

(75) Inventors: Leonhard Weixler, Thierhaupten (DE); Stefan Michael Finkenzeller, Reichertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 473 days.

(21) Appl. No.: 12/857,807

(22) Filed: Aug. 17, 2010

(65) Prior Publication Data

US 2011/0048804 A1 Mar. 3, 2011

(30) Foreign Application Priority Data

Aug. 28, 2009 (EP) ..... 09011062

(51) Int. Cl.
*E21B 10/64* (2006.01)

(52) U.S. Cl.
USPC ..... 175/257; 175/22; 175/23; 175/171

(58) Field of Classification Search
USPC ..... 166/75.11, 77.1, 68.5, 71, 92.1; 175/19, 175/22, 23, 171, 257; 405/249, 232, 228, 405/257
See application file for complete search history.

(56) References Cited

U.S. PATENT DOCUMENTS

| | | | | |
|---|---|---|---|---|
| 1,398,222 | A * | 11/1921 | Frederick | 37/182 |
| 5,653,556 | A | 8/1997 | White | |
| 2001/0041099 | A1 * | 11/2001 | Kato et al. | 405/257 |

FOREIGN PATENT DOCUMENTS

| | | | |
|---|---|---|---|
| DE | 4308856 | C1 | 5/1994 |
| DE | 10155105 | C1 | 4/2003 |
| EP | 1154078 | A2 | 11/2001 |
| EP | 1577253 | A1 | 9/2005 |
| JP | H10-176478 | A | 6/1998 |
| JP | 2001-317282 | A | 11/2001 |
| WO | 00/23660 | | 4/2000 |

OTHER PUBLICATIONS

European Search Report; EP 09011062; Oct. 12, 2009.

* cited by examiner

*Primary Examiner* — David Andrews
*Assistant Examiner* — Ronald Runyan
(74) *Attorney, Agent, or Firm* — Studebaker & Brackett PC

(57) ABSTRACT

The invention relates to a drilling device and a drilling method for drilling inside a casing tube with a drilling apparatus, which has a supporting frame with a fastening means for fixation with respect to the casing tube and a drilling tool, which is driven in a rotating manner via a telescopic rod by means of a drill drive arranged on the supporting frame. At the upper end of the casing tube a receiving part is arranged in accordance with the invention, onto which the supporting frame can be fastened. The receiving part is adjustably supported between a drilling position and an offset position, in which the receiving part is laterally offset with respect to the casing tube.

9 Claims, 4 Drawing Sheets

62
60
130
10
100
140
30
20
7
3
2
5
140

DRILLING DEVICE AND DRILLING METHOD

The invention relates to a drilling device with a drilling apparatus for drilling inside a casing tube, the drilling apparatus having a supporting frame with a fastening means for fixation with respect to the casing tube and a drilling tool, which is driven in a rotating manner via a telescopic rod by means of a drill drive arranged on the supporting frame.

The invention further relates to a drilling method for producing a drill-hole inside a casing tube, in which a supporting frame of a drilling apparatus is fixed with respect to the casing tube and, by means of a drill drive arranged on the supporting frame, a drilling tool is driven in a rotating manner via a telescopic rod, whereby soil material is removed inside the casing tube A drilling device and a drilling method of such type are known from EP 1 154 078 B1. For the production of a drilled pile in soft underground a casing tube is initially forced or twisted in by means of a known introduction device. To remove the soil material inside the casing tube a crane means is used to place on a drilling apparatus with a supporting frame, which is clamped at the upper end of the casing tube. Via a telescopic Kelly rod a drilling bucket serving as a drilling tool is lowered using the crane means. The drilling tool of the drilling apparatus is driven in a rotating manner via the Kelly rod by a drill drive that is arranged on the clamped supporting frame.

As soon as the receiving space of the drilling bucket is filled with removed soil material, the drilling tool is lifted again by the crane means, the supporting frame is detached from the casing tube and the entire drilling apparatus is swung laterally with respect to the casing tube, and in this position the drilling bucket is emptied. In order to continue drilling afterwards the drilling apparatus is placed onto the casing tube again, the supporting frame is clamped thereto and the drilling tool is lowered once more.

On completion of the drill-hole the drilling tool is removed in its entirety using the crane means and the cavity developed inside the casing tube can be filled for example by inserting a reinforcement cage made of steel and a concrete mass for producing a foundation pile.

All in all, this known drilling method is very efficient because on completion of drilling the drilling apparatus can be moved by the crane means to the next casing tube so that the next drill-hole can be commenced immediately afterwards. Due to the fact that the drilling apparatus is cable-suspended on a crane means a "flying drilling apparatus", so to speak, is created that can be moved by the crane means in a quick and efficient way on difficult terrain in particular.

In the case of unfavorable weather conditions, especially in the case of strong winds, the placing of the drilling apparatus onto the casing tube and the clamping of the supporting frame call for great experience and skill of the operator inside the crane means. Due to swaying movements of the drilling apparatus suspended on the crane cable, time delays may occur during the work process.

The invention is based on the object to provide a drilling device and a drilling method, which enable an efficient production of a drill-hole in a casing tube even under adverse weather conditions.

In accordance with the invention the object is solved by a drilling device having the features of claim 1 and respectively by a drilling method having the features of claim 8. Preferred embodiments of the invention are stated in the respective dependent claims.

The drilling device according to the invention is characterized in that at the upper end of the casing tube an adjustable receiving part is arranged, onto which the supporting frame can be fastened, and that the receiving part is adjustably supported between a drilling position, in which the drilling apparatus is located at the receiving part on the same axis with respect to the casing tube, and an offset position, in which the receiving part is laterally offset with respect to the casing tube.

A fundamental idea of the invention resides in the fact that during the production of the drill-hole the drilling apparatus is no longer detached completely from the casing tube for example for emptying the drilling tool or when carrying out measuring or maintenance operations. Instead, the drilling apparatus stays connected to the casing tube and is adjusted thereon in a defined manner. According to the invention the drilling apparatus is no longer clamped directly on the casing tube but on a receiving part provided thereon, which is adjustably supported on the casing tube. Hence, for example in the case of strong winds a quick and reliable adjustment of the receiving part with the drilling apparatus located thereon between a drilling position and an offset position, in which the drilling tool can be emptied for example, can be effected. By preference, the offset position is arranged such that free access is also provided to the upper opening of the casing tube so that e.g. measurements or additional work operations can be performed inside the drill-hole.

As a result, the work process is facilitated in its entirety, allowing for a quick and reliable emptying of the drilling tool even in the case of strong wind conditions. Thus, the drilling device according to the invention can also be employed e.g. in offshore regions for the production of foundation piles in ocean beds. Strong coastal winds as well as swaying movements of a crane means arranged on a water vehicle therefore have hardly any bearing on the work process.

Basically, the adjustment of the receiving part can take place through a corresponding movement of the crane means on which the drilling apparatus is suspended. In such case the receiving part would be guided in a passive manner with respect to the casing tube. However, according to the invention it is particularly preferred that an adjusting means with drive is provided, with which the receiving part can be adjusted between the drilling position and the offset position. The drive of the adjusting means can be arranged on a platform situated on the casing tube or on the drilling apparatus, as for example on the supporting frame. The adjusting movement takes place along a guide.

Basically, for adjustment a pivot joint can be provided so that through a rotary movement the receiving part can be pivoted with respect to the casing tube. A particularly simple and reliable arrangement is achieved in accordance with the invention in that the adjusting means has a carriage that is guided along a displacement path. For this purpose the displacement path can have one or two guide rails for a linear sliding movement. However, other types of adjusting movements can be provided, too.

Basically, various kinds of drilling tools can be used on the drilling apparatus. According to the invention, discontinuously operating drilling tools, including augers that twist themselves into the soil, are especially advantageous. For work operations carried out in soft soil types or under water it is of advantage in accordance with the invention that the drilling tool is designed as a drilling bucket with a bottom which can be hinged open for emptying the drilling bucket.

A further development in accordance with the invention resides in the fact that an actuating mechanism is provided, which is designed for hinging open the bottom of the drilling bucket when the drilling bucket is arranged in the offset position. In a known manner the hinged bottom first of all has an opening with cutting means so that soil material can be removed and conveyed through the opening into the cylindrical receiving space of the drilling bucket. In certain embodiments a screw can be arranged as an additional conveyor means inside the drilling bucket. When the receiving space is filled the opening is closed through a twisting movement of the bottom and the drilling bucket with the removed soil material is withdrawn from the casing tube into the receiving part. Afterwards, the drilling bucket can be moved together with the receiving part into the offset position for emptying. By means of an actuating mechanism, which can be actuated for example through a short lifting movement of the drilling apparatus by the crane means, a bottom lock can be unlatched. In this way, the bottom can hinge open about a pivot joint so that as a result of gravity the soil material can fall out of the receiving space of the drilling bucket.

Another preferred embodiment of the invention results from the fact that during adjustment of the receiving part from the offset position into the drilling position a hinged open bottom of the drilling bucket can be closed. The use of a wedge-shaped or ramp-shaped positioning element makes it possible e.g. during an adjusting movement back into the drilling position for the hinged open bottom to be pushed back into its closed position, with the lock of the bottom being latched again. Once the drilling tool with the receiving part is located in the drilling position again, the drilling tool can be lowered by the telescopic rod into the casing tube for continuation of the drilling process.

According to the invention it is preferred that at the upper end of the casing tube a platform is provided, on which the receiving part and the adjusting means are arranged. Through suitable fastening means the platform with the receiving part is detachably connected to the casing tube. On completion of the drilling operations the platform can then be detached from the casing tube and placed onto a new casing tube that has been forced into the soil. For this purpose the platform can have appropriate connection means for a cable suspension.

With regard to the drilling method the invention is characterized in that the supporting frame of the drilling apparatus is fastened onto a receiving part, which is arranged at the upper end of the casing tube, and in that by means of the receiving part the drilling apparatus is adjusted between a drilling position, in which the drilling apparatus is located at the receiving part on the same axis with respect to the casing tube, and an offset position, in which the receiving part is laterally offset with respect to the casing tube.

As set out above, due to the receiving part according to the invention a speed-up and simplification of the work process is accomplished.

According to the invention a preferred procedure resides in the fact that in the offset position a drilling tool of the drilling apparatus is emptied of removed soil material. In this manner a discontinuous method can be carried out, which is particularly advantageous in the case of soft soils.

In accordance with the invention it is intended that both in the drilling position and in the offset position the drilling apparatus is held via a telescopic rod on a crane means. In particular, the crane means can be a boom or a crane commonly used on construction sites, on which the drilling apparatus is suspended on a crane cable. The telescopic rod can, in particular, be a so-called Kelly rod that is actuated directly by the crane cable for adjustment of the drilling tool. The drilling method according to the invention is especially suitable for being implemented using a crane means on a ship or a different type of water vehicle, which is exposed to especially strong swaying movements caused, for example, by the movement of the waves.

Furthermore, according to the invention provision is made for the casing tube to be introduced, in particular forced into the soil. For this a known pushing device can be employed. In addition, it is in accordance with the invention that subsequently the produced drill-hole in the casing tube is filled with a concrete mass and a drilled pile is formed.

To implement the drilling method use can, in particular, be made of a drilling apparatus, as known for example from EP 1 154 078 B1 mentioned above.

The invention will be described further by way of preferred embodiments shown schematically in the accompanying drawings, wherein.

Figures 1A, 1B, 1C:
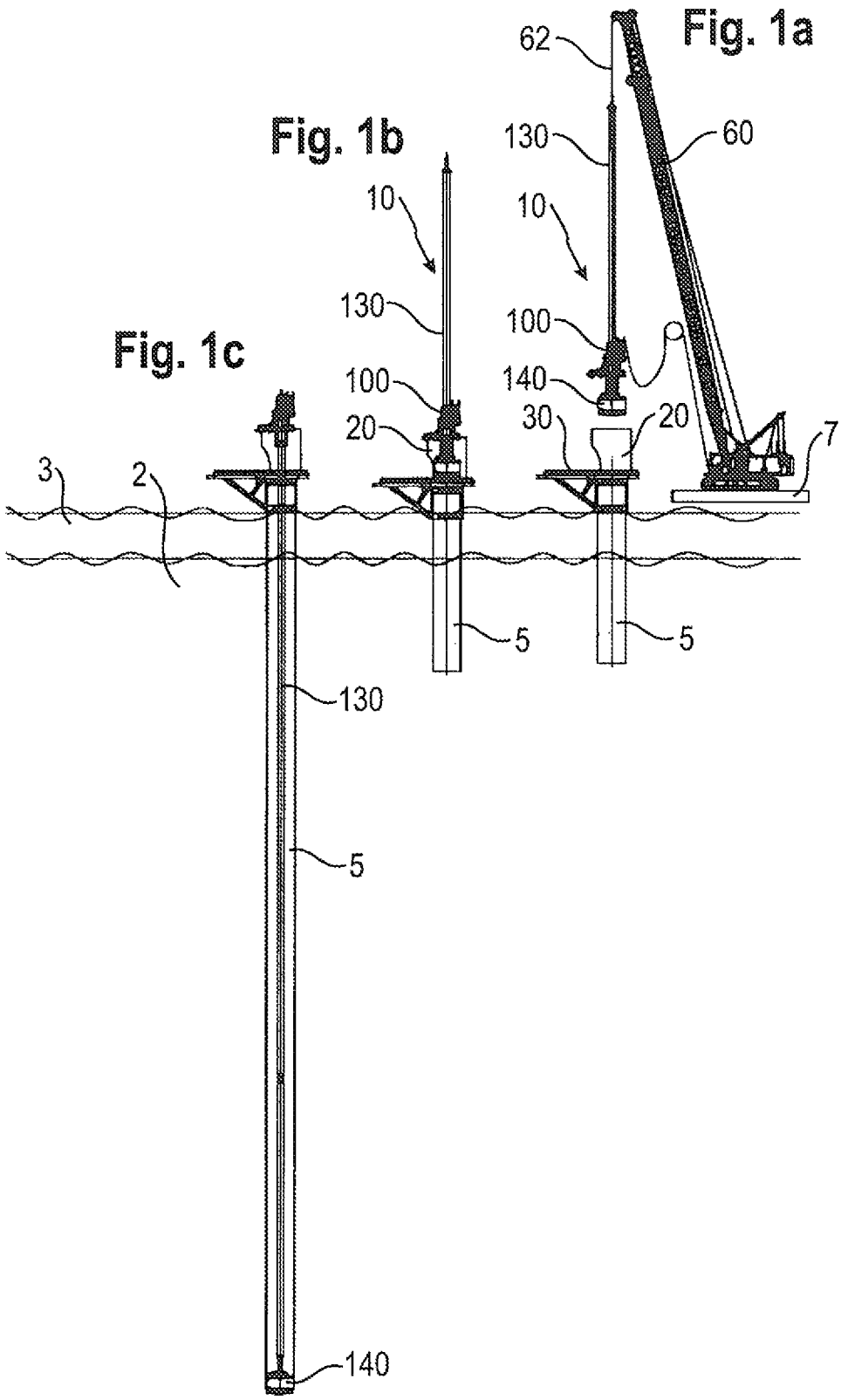
FIG. 1 shows schematic views of the device and method according to the invention in different stages during the production of the drill-hole.

In FIG. 1*a* the initial phase during the implementation of a drilling method according to the invention is shown. First of all, a casing tube 5, shown in part only, is introduced in a manner known per se with an introduction device into a relatively soft soil 2, which is located in the illustrated embodiment below a body of water 3. The casing tube 5 projects above and beyond the surface of the body of water 3 so that in the upper area of the casing tube 5 a receiving part 20 can be attached in a rotationally fixed manner. In the illustrated embodiment a platform 30 is in addition detachably fastened in the upper area of the casing tube 5.

As part of the drilling device 10 according to the invention a drilling apparatus 100 is lowered in the direction of the receiving part 20 by means of a telescopic rod 130 that is held by a crane cable 62 on a crane means 60. In the present example the crane means 60 comprises a track-bearing vehicle with boom that is arranged on a floating pontoon 7.

As shown in FIG. 1*b*, the drilling apparatus 100 is lowered into the approximately tubular receiving part 20 and fastened onto the upper side of the said receiving part 20. In the illustrated position according to FIG. 1*b* the receiving part 20, together with the drilling apparatus 100 received therein and the telescopic rod 130, is located on the same axis with respect to the center axis of the casing tube 5. In this drilling position, through extension of the telescopic rod 130 it is then possible for a drilling tool 140 of the drilling apparatus 100 to move into the casing tube 5 and drill out soil material located therein.

In FIG. 1*c* a possible final depth is shown, in which the three-fold extensible telescopic rod 130 is extended.

Basically, the casing tube 5 can extend as far as the lower end of the drill-hole, i.e. up to the drill-hole bottom. In this case a fully cased drill-hole would be made. Alternatively, the casing tube 5 can only be arranged in an upper area of the drill-hole, in which relatively soft soil material is present. If soil layers of greater stability are situated underneath, a further casing installation is not required so that the drill-hole can also be sunk below a casing tube 5.

Figure 2:
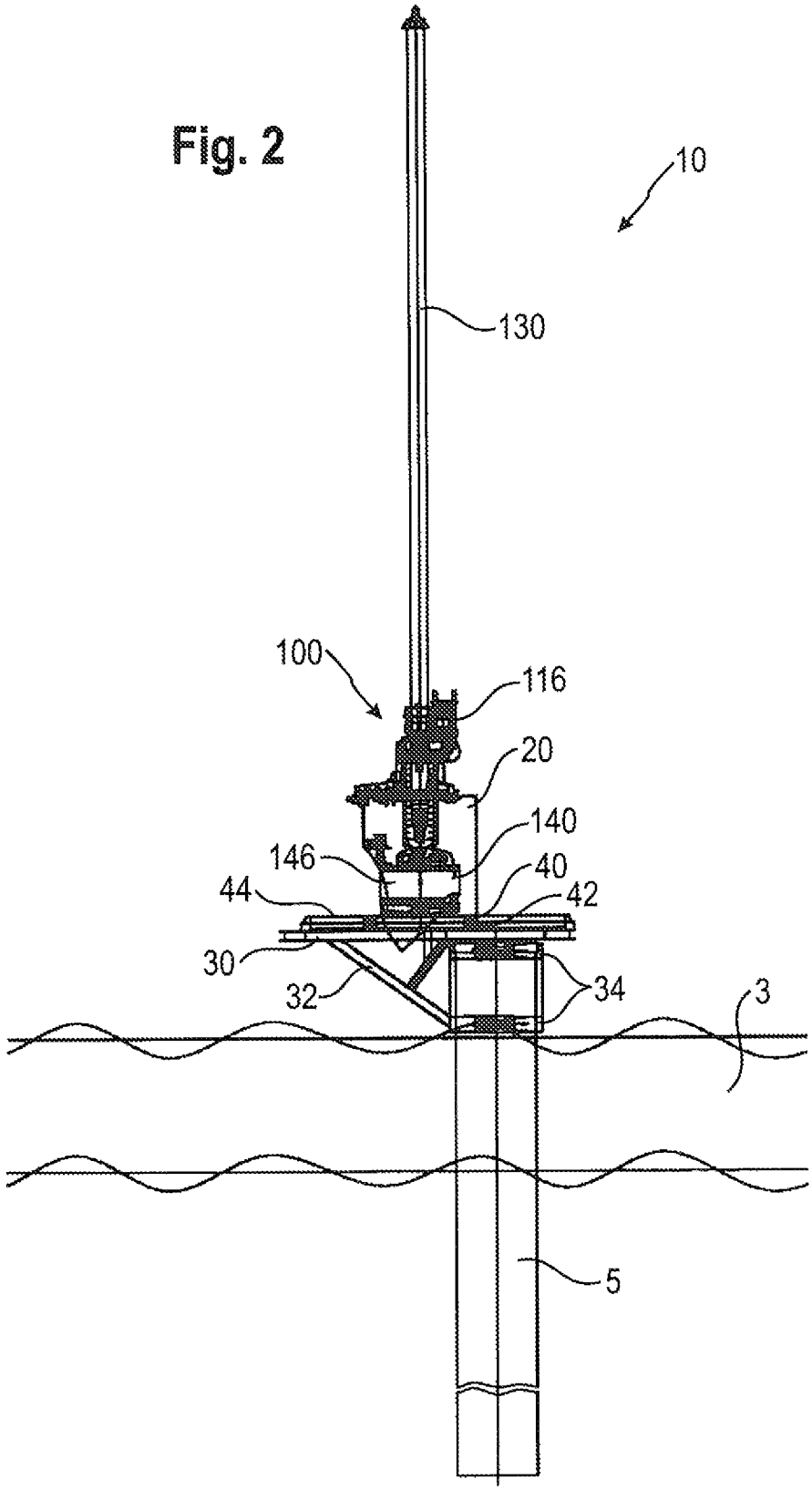
FIG. 2 shows a schematic side view during adjustment of the drilling apparatus from the drilling position to the offset position.

As can be taken from FIG. 2, in the drilling device 10 according to the invention the drilling tool 140 is designed as a drilling bucket with a cylindrical receiving bucket 146 that serves for carrying out a discontinuous drilling method.

Through a corresponding rotary motion of the drilling tool 140, which is driven in a rotating manner via the telescopic rod 130 by means of a drill drive 116, soil material is removed inside the casing tube 5 and conveyed through an opening in the bottom into the receiving bucket 146. When this is filled, the drilling tool 140 is then, upon the opening in the bottom of the drilling tool 140 having been closed through a short counter-rotation, moved via the telescopic rod 130 and the crane cable 62 out of the casing tube 5 back into the receiving part 20. Afterwards, the receiving part 20 with the drilling tool 100 is moved by an adjusting means 40 into an offset position. To this end, the adjusting means 40 has a displacement path 44 with rails arranged transversely to the casing tube 5 along the platform 30. At the underside of the sleeve-shaped receiving part 20 a carriage 40 is located which can be moved along the displacement path 44 by means of a drive not shown.

As depicted in FIG. 2, the platform 30 is arranged in an approximately horizontal manner above the body of water 3 and detachably fastened through a support structure 32 and holding collars 34 onto the upper end of the casing tube 5.

Figure 3:
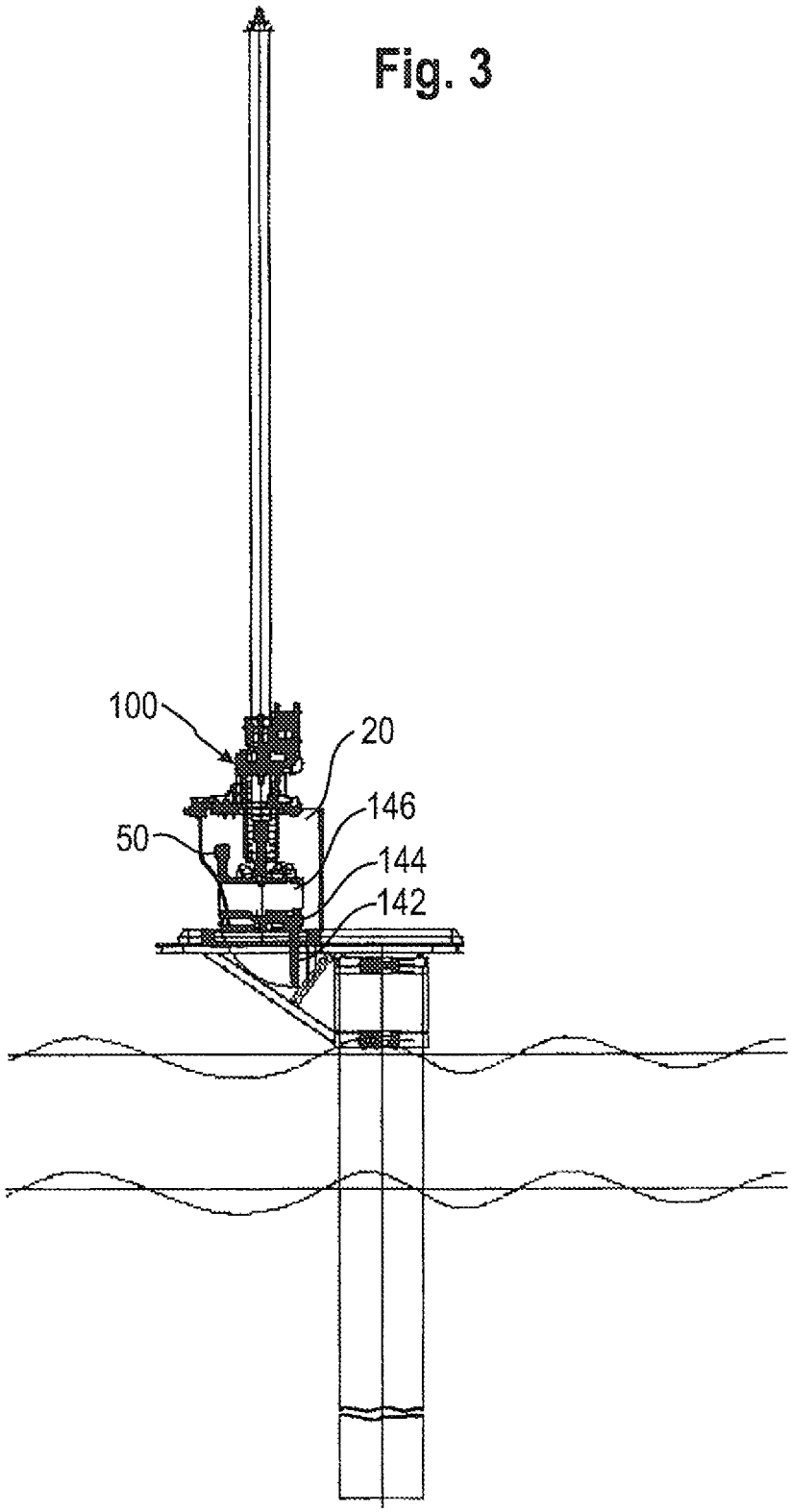
FIG. 3 shows a schematic side view of the drilling device in the offset position.

On reaching the offset position shown in FIG. 3 a bottom 142, which is hinged via a hinge joint 144 to the underside of the receiving bucket 146, can be opened by an actuating mechanism 50. The bottom 142 can hinge open into the illustrated vertical position so that soil material located inside the receiving bucket 146 can fall downwards. Afterwards, the receiving part 20 with the drilling apparatus 100 is again moved to the right towards the casing tube 5 back into the drilling position. In doing so, the bottom 142 is pushed back into the horizontal closed position on the receiving bucket 146, in which the bottom 142 latches through a lock not depicted here. Following this, a new drilling step can be performed until the receiving bucket 146 is filled once more and has to be moved into the offset position again for being emptied.

Figure 4:
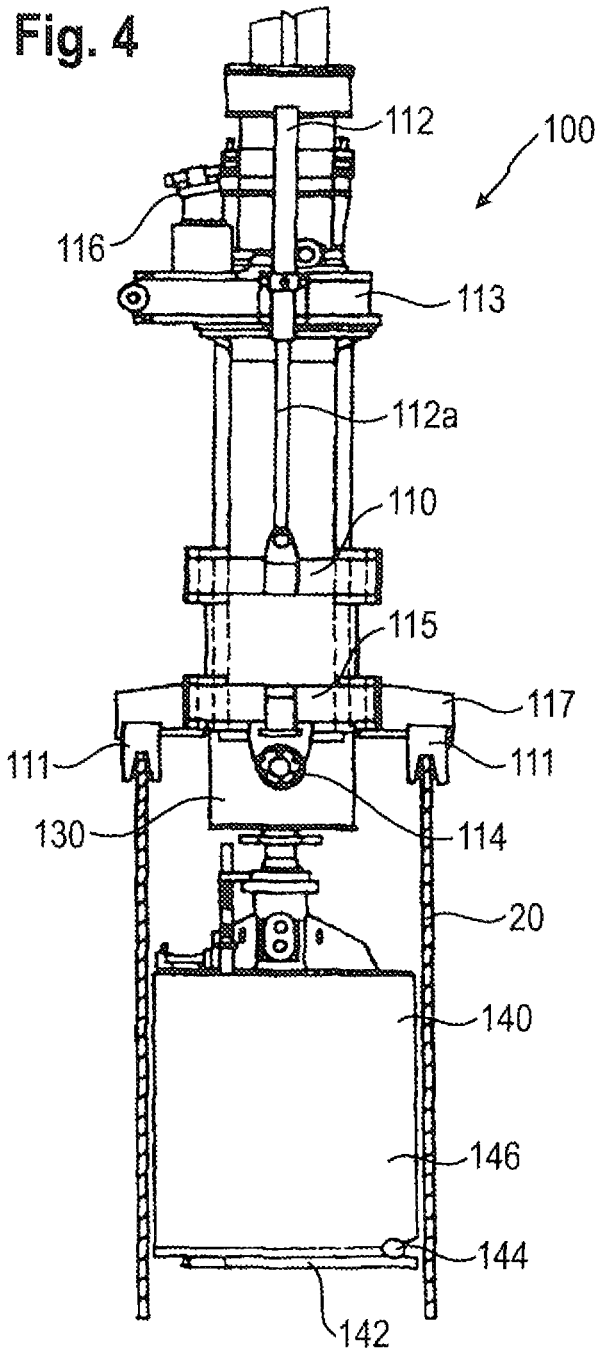
FIG. 4 shows a schematic part cross-sectional view of a drilling apparatus according to the invention.

A preferred fastening of the drilling apparatus 100 onto the receiving part 20 is shown schematically in FIG. 4. The drilling apparatus 100 has a supporting frame 110 which is provided with cross members 117 at its lower end. On the underside of the cross members 117 placing brackets 111 are arranged on the one hand, with which the drilling apparatus 100 can be placed onto an upper edge of the sleeve-shaped receiving part 20. Located offset to the placing brackets 111 one or more fastening means 114 are provided that have hydraulically operated collets. With these collets the supporting frame 110 can be fastened in a rotationally fixed manner onto the receiving part 20.

Furthermore, also arranged on the supporting frame 110 is the drill drive 116 for driving the drilling tool 140 in a rotating manner via the telescopic rod 130.

In the illustrated embodiment the supporting frame 110 is of a two-part design with a lower supporting frame part 115 and an upper supporting frame part 113 arranged above. On the upper supporting frame part 113, which can be adjusted axially with respect to the lower supporting frame part 115 by means of hydraulic cylinders 112 with hydraulic cylinder pistons 112*a*, the drill drive 116 is arranged in a fixed manner.

By detaching the fastening means 114 the drilling apparatus 100 can be pulled upwards out of the receiving part 20 and then placed onto a receiving part on another casing tube in order to produce a further drill-hole.

The invention claimed is:

1. Drilling device with a drilling apparatus for drilling inside a casing tube, the drilling apparatus having a supporting frame with a fastening means for fixation with respect to the casing tube and a drilling tool, which is driven in a rotating manner via a telescopic rod by means of a drill drive arranged on the supporting frame, wherein at an upper end of the casing tube an adjustable receiving part is arranged, onto which the supporting frame of the drilling apparatus can be fastened, the receiving part is adjustably supported between a drilling position, in which the drilling apparatus is located at the receiving part on the same axis with respect to the casing tube, and an offset position, in which the receiving part is laterally offset with respect to the casing tube;

an adjusting means with drive is provided, with which the receiving part can be adjusted between the drilling position and the offset position;

wherein at the upper end of the casing tube a platform is provided, on which the receiving part and the adjusting means are arranged.

2. Drilling device according to claim 1, wherein the drilling tool is designed as a drilling bucket with a bottom which can be hinged open for emptying the drilling bucket.

3. Drilling device according to claim 2, wherein an actuating mechanism is provided, which is designed for hinging open the bottom of the drilling bucket when the drilling bucket is arranged in the offset position.

4. Drilling device according to claim 2, wherein during adjustment of the receiving part from the offset position into the drilling position a hinged open bottom of the drilling bucket can be closed.

5. Drilling device according to claim 1, wherein the adjusting means has a carriage that is guided along a displacement path.

6. Drilling method for producing a drill-hole inside the casing tube, in particular by means of a drilling device according to claim 1, in which the supporting frame of the drilling apparatus is fixed with respect to the casing tube and, by means of the drill drive arranged on the supporting frame, the drilling tool is driven in the rotating manner via the telescopic rod, whereby soil material is removed inside the casing tube, wherein the supporting frame of the drilling apparatus is fastened onto a receiving part which is arranged at the upper end of the casing tube.

7. Drilling method according to claim 6, wherein in the offset position the drilling tool of the drilling apparatus is emptied of removed soil material.

8. Drilling method according to claim 6, wherein both in the drilling position and in the offset position the drilling apparatus is held via a telescopic rod on a crane means.

9. Drilling method according to claim 6, wherein the casing tube is introduced into the soil and subsequently a concrete mass is filled into the produced drill-hole in the casing tube and a drilled pile is formed.

* * * * *